United States Patent [19]

Smith

[11] Patent Number: 4,860,685

[45] Date of Patent: Aug. 29, 1989

[54] TREATMENT OF CELLULOSIC MATERIALS

[76] Inventor: Richard D. Smith, 224 Early St., Park Forest, Ill. 60466

[21] Appl. No.: 49,394

[22] Filed: Mar. 9, 1987

Related U.S. Application Data

[63] Continuation-in-part of Ser. No. 753,663, Jul. 10, 1985, abandoned.

[30] Foreign Application Priority Data

Jul. 10, 1986 [WO] PCT Int'l Appl. ..... PCT/US86/01438

[51] Int. Cl.[4] ..... B05C 5/00

[52] U.S. Cl. ..... 118/300; 118/500; 427/140; 427/421; 68/205 R

[58] Field of Search ..... 134/94, 95, 96, 172, 134/198, 200, 201; 118/302, 429, 300, 500; 68/20, 205 R, 240; 427/421, 320, 140

[56] References Cited

U.S. PATENT DOCUMENTS 3,179,341 4/1965 Plos et al. ..... 118/302 X
3,182,670 5/1965 Howell ..... 134/107
3,676,182 7/1972 Smith ..... 427/421
3,939,091 2/1976 Kelly, Jr. ..... 427/421 X
4,120,180 10/1978 Jedora ..... 68/205 X
4,410,560 10/1983 Kosterka ..... 427/35 X

FOREIGN PATENT DOCUMENTS 1436431 5/1976 United Kingdom ..... 118/42 X

*Primary Examiner*—Frankie L. Stinson
*Attorney, Agent, or Firm*—Fitch, Even, Tabin & Flannery

[57] ABSTRACT

A treatment system for cellulosic materials is provided which is particularly adapted for the manual treatment of single pages of books, as well as documents, engineering drawings, maps, and works of art on paper. The system includes a deacidification, self-pressurized solution comprising a deacidification agent, a lower alcohol solvent for the agent, a diluent, and a propellant; delivery apparatus for shipping, storing, and spraying the solution; and a novel cleaning solution for use in conjunction with the deacidification solution and apparatus.

13 Claims, 1 Drawing Sheet

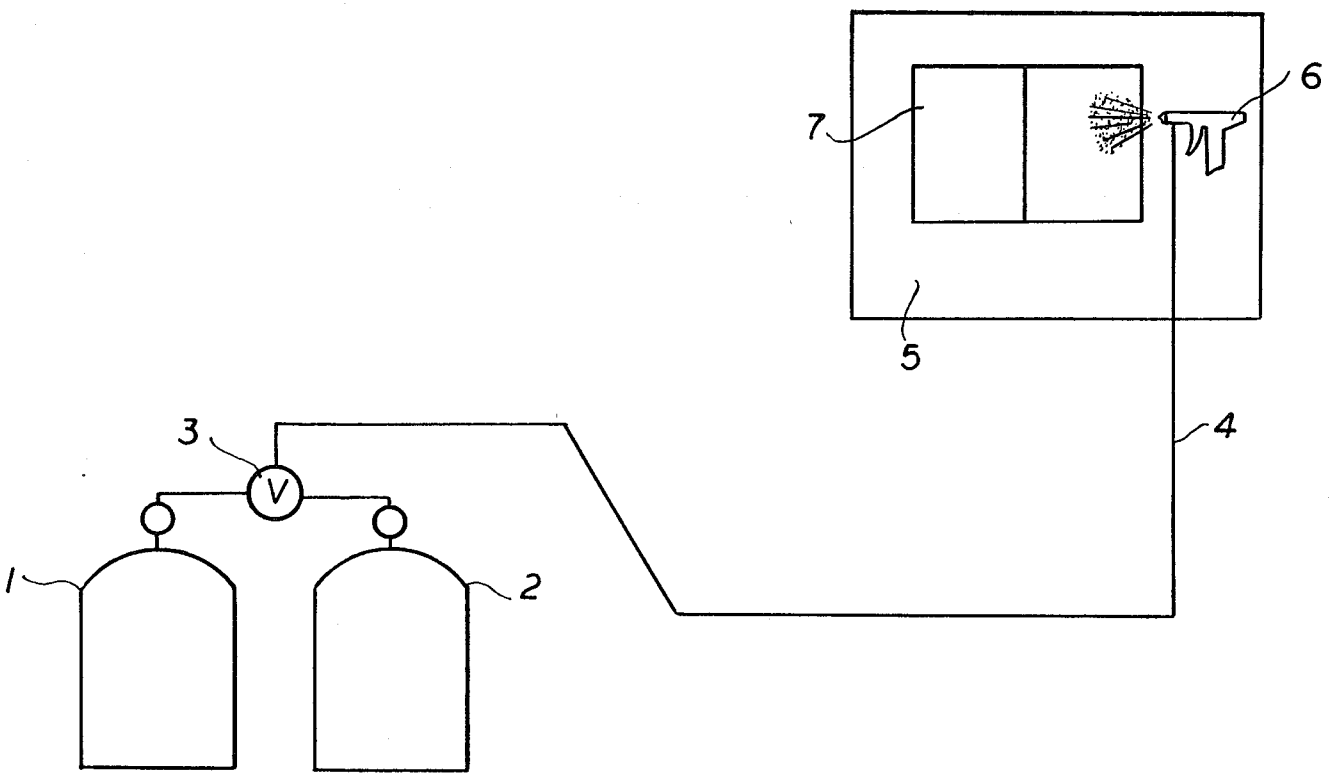
1
2
3
4
5
6
7

TREATMENT OF CELLULOSIC MATERIALS

This is a continuation-in-part of application Serial No. 753,663, filed July 10, 1985 and now abandoned.

The present invention relates generally to the treatment of cellulosic materials which may deteriorate or which may have become deteriorated through aging. The invention, more particularly, is directed to the preservation of printed paper materials, such as books, documents, and manuscripts which, through aging, have lost or may lose some of their initial properties.

BACKGROUND OF INVENTION

The deterioration and preservation of printed cellulosic materials such as books, documents, manuscripts, and works of art on paper is a serious problem throughout the world. Large quantities of these materials have deteriorated to such an extent that only a very few, if any, people can use them; and if so, only under restricted conditions because these materials are embrittled and very fragile. The problem is not limited to isolated instances of the deterioration of individual examples of rare and ancient documents, but alarmingly threatens virtually all portions of archive, library, and museum collections. Up to 40 percent of virtually irreplaceable books and records in major research library collections are so deteriorated that they cannot be read.

Acid-catalyzed hydrolysis of the cellulose during aging, causing up to 95 percent of the deterioration, is considered the most significant cause of deterioration of cellulosic materials. Acid attack causes degradation of cellulose by random schism of the hemi-acetal links between the anhydro-glucose monomers that make up cellulose molecules. This reaction shortens the molecules, and weakens, and embrittles cellulosic material. Acids catalyze this reaction and the presence of hydrogen ions associated with an acidic condition in paper greatly accelerates the rate of deterioration. An acidic condition may result from the way cellulosic materials are manufactured, from storage conditions, or from natural aging. The acidity may come from the use of papermaker's alum in paper making, air pollutants, or the degradation products of the cellulosic material and printing ink mediums. Oxidative and photochemical degradation, and other aging mechanisms have a similarly deleterious effect on cellulosic materials, but cause a lower amount of deterioration.

Most of the present day library collections have been published since the early nineteenth century. Chemical wood pulp fibers, prepared with alum-rosin sizes, not only make up most of the paper in library collections, but contain the seeds of its own destruction. Alum-rosin sizing is the primary source of acidity in paper; and this acidity is the primary cause of paper deterioration. Conventional wood pulping processes may also degrade and/or oxidize the cellulose fibers, or may not remove all unstable non-cellulosic materials from the wood.

In general, library collections are printed on acidic paper with poor aging characteristics. In terms of their lifetimes, many library books have reached old age or are rapidly approaching it. My studies indicate that almost all books published between 1900 and 1960 cannot be effectively rebound after they are 60 years old, and will be unable to resist even mild use when they are 100 years old. The urgency of the situation is compounded by acidic and oxidizing air pollutants, such as sulfur and nitrogen oxides, which accelerate the deterioration of ordinary paper and even cause otherwise permanent paper to deteriorate, embrittle, and discolor.

This appalling deterioration of the records of our society is not limited to library collections but is equally true for the collections of archives and museums, and the collections of private individuals.

STATE OF THE ART

Deacidification, i.e. neutralization of acidity and introduction of an alkaline reserve to prevent reacidification in the future, is the accepted treatment to alleviate acidic attack. A known technology using aqueous and nonaqueous liquid solutions, as well as gases, has developed in respect to deacidification of cellulosic materials. Both organic and inorganic deacidification agents have been employed. A nonaqueous technology has been developed for deacidification of both books and documents as disclosed in my U.S. Pat. No. 3,676,182. This nonaqueous deacidification technology is effective for low unit cost, mechanized, mass deacidification of books in large quantities as well as for the more expensive manual treatment of unique paper artifacts, such as documents and works of art on paper.

What has not been developed is a low cost, high quality treatment for protecting small to medium size collections or articles of moderate value, e.g. books from the Special Collections of scholarly libraries or books belonging to collectors. These books warrant more individual attention than is given to books being deacidified in the mass deacidification systems but not so much care as the rare, unique, or valuable books being deacidified by professional conservators in their one-on-one processes.

Another illustration of this unsolved middle ground is the problem picture framers have because they are unable to deacidify prints and other works of art on paper at costs which their clients can afford. In addition, archival record institutions, e.g., land, marriage and other legal record offices, though not having the numbers of books that justify a mass system, do have many more books than are treatable by, and at the cost of, a one-on-one treatment.

Other arts are not helpful in providing an alternate treatment method. For example, the dry cleaning and spot removal arts also work with cellulosic materials but the wear and tear caused by the tumbling that wetted textiles undergo during washing and dry cleaning would destroy books and abrade the printing from their surfaces. Spotting treatments depend upon flushing controlled quantities of fluids through the fabric. These fluids, whether aqueous or nonaqueous, have the purpose of removing foreign materials such as stains from the materials.

The cleaning arts are intended to, and do, remove dirt, spots, and stains from cellulosic materials. By contrast, the present invention is designed to effect no change beyond depositing a benign, stabilizing deacidification agent which neutralizes existing acids and serves to prevent their redevelopment in the future. These agents are dissolved in a solution which introduces the agents as a gentle, soft spray that does not affect or abrade printing inks and other surface deposits. The solvents are removed as vapors leaving the deacidification agents throughout the treated cellulosic materials. By contrast, spotting solvents are applied vigorously to remove stains and foreign materials. This abrasive type of application would tear fragile papers and even remove, i.e. destroy the printing inks that are on cellulosic materials. In general, the application pressures and vacuums with which spotting solvents are applied and removed are considerably greater than the pressures and vacuums practiced in my invention.

The existing deacidification art fails to meet well recognized needs. Amongst other problems the known art can be costly, labor expensive, hazardous to workers, involves flammable or explosive solvents, lacks convenience, and/or dissolves many inks. Excess costs can occur as a consequence of solvent evaporation loss during spraying and transfer from shipping to use containers, extra labor from greater clean-up and downtime needs, and other operating costs. Labor expensive problems arise from spray orifice clogging. Solvents may be flammable and produce explosive and poisonous vapors, and may dissolve many inks. Gases like nitrogen and carbon dioxide when used by unskilled library personnel often introduce hazards because these personnel are neither trained nor competent to work with these materials.

OBJECTIVES OF THE INVENTION

Accordingly, an object of this invention is to provide an improved, low cost, highly effective treatment system equivalent in quality to presently accepted one-on-one museum deacidification treatments for unique books, records, and works of art on paper.

Another object is to make the unstable, normally unavailable chemicals used by highly-qualified professional conservators for their one-on-one deacidification treatments readily available in stabilized form for use by semi-skilled persons in preserving books and other record materials and works of art on paper.

Another object is to provide simple treating apparatus comprising specially designed components to provide a treating system that persons of ordinary skill can readily utilize.

A further object is to provide a treating system which can be utilized by highly skilled personnal for treatment of unique or highly valuable items, as well as, by persons of ordinary skill for treatment of low-value records whose importance lies not in the item itself but rather as a component of a large records collection.

An additional object is to provide a stable, non-poisonous, non-flammable and non-explosive deacidification system suitable for use in libraries and office buildings, and in other high-use buildings and congested work areas.

Another object is to provide a simplified treating system which, with exception of the exhaust duct, is self-contained and requires only access to a conventional electrical outlet.

A further object is to provide a treating system which uses deacidification formulations and application techniques that have essentially no effect on inks, i.e. do not deface or remove or cause ordinary inks to run, feather or smudge.

An additional object is to provide a treating system which can be operated by one individual, or can be mechanized, as for example, by using a continuous belt conveyor to transport single sheets of paper (manuscripts, records, maps, and works of art) through a spray and dry deacidification system.

A further object is to provide a treating system using sprays having improved safety and solution stability thereby avoiding the hazards and potential for contamination during transfer and handling of solutions from shipping to use cylinder.

A further object of this invention is to pacify carbon steel of ordinary pressure vessels so they will not react with or discolor the nonaqueous deacidification sprays and cleaning solutions.

Another object is to reduce the loss and spoilage of nonaqueous deacidification solution occuring during transfer of solution from shipping to spraying container or from leakage into the shipping container due to difficulty in resealing subsequent to initial transfer.

A further object is to improve safety by removing the necessity for high pressure gases in operating the treating system.

Another object is to allow use of low cost carbon steel pressure containers instead of glass-lined or inert plastic-lined steel or stainless steel or glass or glass-lined containers.

These and other objects of the invention will become apparent by reference to the following description and accompanying drawing which shows schematically the treatment system of the invention.

SUMMARY OF THE INVENTION

This invention is particularly intended for utilization by ordinary archive, library or museum personnel, as well as others like collectors or employees of picture framers and book binderies. The facilities are frequently minimal and personnel relatively unskilled. For example, loading docks and facilities for handling heavy cylinders are not available. In these circumstances, this invention provides a nonaqueous deacidification system including the following four components:

(1) Deacidification Solution: A stable, self-pressurized, nonaqueous deacidification solution, the utilization of which
   (a) neutralizes the harmful acidic substances in paper, and
   (b) deposits a benign buffering agent to protect against re-acidification in the future. The deacidification solution can be shipped and stored in ordinary, unlined carbon steel disposable containers.

(2) Cleaning Solution: A stable, self-pressurized, nonaqueous cleaning solution which flushes and scrubs the Delivery System clean after use, and which can be shipped, stored, and used in conventional, unlined carbon steel disposable containers.

(3) Delivery System: An airless spraying system for transferring the nonaqueous deacidification solution to a spray gun and applying the solution by means of the spray gun to new or deteriorated, even fragile and embrittled, materials undergoing deacidification, and (4) Spray Booth: A simple, low cost, specially designed spray booth for spray deacidifying both single sheet artifacts, such as documents, prints, and works of art on paper, as well as bound aggregates of paper sheets like books, pamphlets, or other cellulosic materials.

A more complete description of these components and disclosure of their novel characteristics and unique functions follows.

As indicated, this invention relates to improvements in the manufacture and use of self-pressurized nonaqueous deacidification solutions, such as those first described in U.S. Pat. No. 3,676,182, and improved upon in U.S. Pat. Nos. 3,939,091 and 4,318,963. The solutions of this invention has been further stabilized so they can be manufactured, stored, and shipped in new, non-pacified carbon steel pressure cylinders such as are used to deliver air conditioning and refrigeration solvents.

The stable self-pressurized nonaqueous chemical deacidification solutions of this invention are composed of organic solvents in combination with a self-pressurizing propellant in which a deacidification agent is dissolved. Although a variety of solvents exist that dissolve deacidification agents, do not harm paper or other record components, and are theoretically suitable, most of these organic solvents are not fully satisfactory because they introduce health and other hazards when used alone in effective amounts so as to Oequire unusual precautions, or may damage books due to their wetting and drying characteristics or dissolving properties.

In accord with the invention, small amounts of a lower alcohol, or the equivalent, are used to initially dissolve the deacidification agent and provide a stable solution when combined with a chlorofluorocarbon diluent. The lower alcohol should have a carbon chain length of 1 to 3. These small amounts do not result in hazardous conditions when used in combination with the chlorofluorocarbon diluent. Larger amounts of alcohol may be used when the alcohol has a chain length of 2 to 3.

The preferred deacidification agent is a Group II alkaline earth alkoxide, preferably a magnesium alkoxide dissolved in a lower alcohol in the presence of carbon dioxide. Examples are: methoxy magnesium methyl carbonate and ethoxy magnesium ethyl carbonate.

The deacidification solution should be nonaqueous and comprises a diluent of a chlorofluorocarbon having a boiling point below that of the lower alcohol which is present in sufficient amount to dissolve the deacidification agent. Chlorodifluoromethane is included as a propellant, and the deacidification solution further includes the deacidification agent. The diluent is used in the range of from 60 to 90 percent by weight, but is typically used at about 85 percent by weight. The lower alcohol is present in the formula at between 0.5 and 20 percent by weight and preferably between 0.5 and 10 percent by weight, in the case of methanol and most frequently about 5 percent by weight. The ethanol and propanol may be present at up to 35 percent by weight. Methanol is used at as low a level as is feasible because of its inherent hazards and problems and is present at a percentage level which is sufficient to dissolve the deacidification agent, usually 2:1 alcohol to agent or greater, but generally not greater than 10:1 to avoid the problems that the use of methanol causes.

The deacidification agent is used in the range from 0.1 to 10 percent by weight, most typically at about 1 percent by weight. The level of deacidification agent is such as to provide in the paper the deacidification agent at a level of about 1 percent of the paper weight.

The propellant is incorporated at levels ranging from 5 to 25 percent by weight, most typically at about 10 percent by weight. The propellant provides self-pressurization and avoids the need for high pressure cylinders or containers. The level of propellant is chosen so as to provide a generally uniform pressure while delivering a soft spray so as to avoid abrasion of print on the paper. The propellant should have a boiling point well below 0° F. and will substantially evaporate before the solution is applied to the paper. Additionally pressurizing and propelling may be improved by an inert gas such as nitrogen. This inert gas serves to make the delivery of the solution by the propellant more uniform and can be conveniently added when the deacidification solution is mixed.

The ratio of propellant to diluent should be in the range of from about 1:3 to about 1:9 in the case of the preferred diluent, trichlorotrifluoroethane, dependent upon the kind and amount of lower alcohol. The ratio range will be different, normally lower, i.e., more propellant is required when diluents with higher boiling points are used. The ratio of propellant to alcohol should be in the range of from about 1:15 to about 1:0.4, dependent upon the kind of and quantity of lower alcohol used. The higher ratios are appropriate for the preferred alcohol, methanol, when used at minimum levels. The lower ratios are preferred for other alcohols which are normally used at higher levels. Different ratios may be used when diluents other than the preferred diluent, trichlorotrifluoroethane are used.

Equivalent solvents, propellants, and deacidification agents can be substituted, if they provide the specified characteristics and do not cause detrimental effects to the stability of the solutions or treated materials.

The diluent is preferably trichlorotrifluoroethane but other halogenated diluents can be used such as methyl chloroform, methylene chloride, trichloroethane, trichloroethylene, and perchloroethylene, and chlorofluorocarbon diluents such as trichlorofluoroethane, tetrachlorodifluoroethane and similar commercially available materials. The diluent must be miscible with or soluble to the deacidifying agent dissolved in the lower alcohol. Further, as pointed out, the diluent should have a boiling point below that of the lower alcohol to effect the desired treatment.

The propellant is preferably chlorodifluoromethane, but alternate propellants such as chlorodifluoroethane, dichlorodifluoromethane, butane, propane, ethane, methane, and dimethylether may be used. Different ratios of propellant to alcohol may be selected when alternate propellants are used.

Various inert gases can be substituted for the nitrogen. These insert gases include argon and other noble gases. While gases like methane and ethane can be used, they are desirably avoided because of their flammability.

Alternate deacidification agents are metal organic compounds containing calcium and/or magnesium which are soluble in the lower alcohol to form solutions which can be diluted by the diluents, and which react in air to form stable, benign carbonates, oxides, and hydroxides. Particularly useful examples are ethoxy magnesium ethyl carbonate, propoxy magnesium propyl carbonate, isopropoxy magnesium isopropyl carbonate, magnesium methoxide, magnesium ethoxide, magnesium isopropoxide, and magnesium propoxide. Magnesium methyl carbonate, magnesium propyl carbonate and magnesium isopropyl carbonate, which may be present with the above alkoxides in the presence of excess carbon dioxide, may also be used. The pH of these compounds can be raised by addition of calcium alkoxides or reduced by addition of aluminum alkoxides. In addition, calcium and aluminum alkoxides can be used together to produce preselected pH values based on the ratios of the components used.

CLEANING SOLUTION

Heretofore, nonaqueous deacidification spray solutions, even though they produced excellent deacidification results, have been found expensive and inconvenient for continuous use because their delivery systems sprayed erratically or clogged. In the best of these systems, an anhydrous lower alcohol, e.g. methanol, is used to flush the spray lines and clean the spray gun and its component parts. Methanol, though effective as a flushing agent, introduces hazardous, flammable liquids and vapors and does not properly clean the inside constricted areas of valves, hoses, spray tips, and spray guns.

Far more satisfactory cleaning solutions than methanol containing mostly halogenated solvents, plus some anhydrous methanol, together with significant quantities of dissolved carbon dioxide have been developed. These solutions not only cleaned more effectively than methanol, but also effectively reduced or eliminated the toxicity and flammability hazards. Their self-pressurization nature plus dissolved carbon dioxide provides a built in scrubbing, boiling action which throughly scours and cleans the spray hose, valves, spray tips and spray gun. The carbon dioxide vaporized as it flowed through the spraying components to form bubbles and produce an extremely turbulent mixture of gas and liquid which scoured and dissolved contaminates and residues from the delivery system. This cleaning solution can be left in the gun and spray hose for extended periods of time to prevent recontamination from air, facilitating spraying start-up and greatly reducing the maintenance of dismantling and cleaning the spray gun.

These cleaning solutions contained trichlorotrifluoroethane, chlorodifluoromethane, methanol, and carbon dioxide. The proportion of trichlorotrifluoroethane ranged from 0 to 50 percent by weight. The proportion of chlorodifluoromethane ranged from 0 to 60 percent by weight. The methanol varied from 0 to 95 percent by weight if carbon dioxide only is the propellant but more normally methanol was used at 5 to 25 parts by weight. The carbon dioxide could be used from 1 to 10 percent by weight. The preferred formula was 40 percent by weight trichlorotrifluoroethane, 30 percent by weight chlorodifluoromethane, 20 percent by weight methanol, and 10 percent by weight carbon dioxide. Other halogenated solvents and propellants, lower alcohols, and gases could be used and the above combination met Federal regulations and gave good results. The level of methanol was kept below 12 percent by weight to produce a nonflammable cleaning solution.

However, the above formulation was primarly suitable only for stainless steel, glass-lined, inert-plastic-lined, e.g., epoxy phenolic baked-on lining, or other nonreactive cylinders. The inexpensive, disposable, liquified gas, carbon steel cylinders, such as is used for transporting air conditioning and refrigerant chlorofluorocarbon solvents and fuels like butane or propane, could not be used because of a reaction which caused the cleaning solution to discolor, first becoming amber yellow, and subsequently changing to a deep blue green when large quantities of methanol are present.

The techniques known and practiced to avoid this discoloration are not applicable. For example: (1) introduction of anti-oxidants like nitromethane into alcohol halogenated solvents fails because it produces a yellow colorant on contact with the nonaqueous deacidification solution, or (2) coating the inside of the cylinder with an inert, baked-on epoxy-phenolic lining is impractical due to cost and difficulty in obtaining a complete coating.

I have discovered that these conventional cylinders can be used if in the above formulation (1) the carbon dioxide is deleted or replaced by nitrogen, and (2) for long term stability a small quantity of an alkaline material, preferably methoxy magnesium methyl carbonate, is added to prevent reaction. My preferred formula for the cleaning solution is 48.2 percent by weight trichlorotrifluoroethane, 40.1 percent chlorodifluoromethane, 11.65 percent anhydrous methanol, and 0.05 percent methoxy magnesium methyl carbonate. At this level, the methoxy magnesium methyl carbonate content is so low that the formulation is still effective as a cleaning solution. Smaller and larger quantities of alkaline agent may be used dependent upon factors including the reactivity of carbon steel, the composition of the cleaning solution, the storage time and storage conditions. At a pH in the range of from about 6 to about 8, and preferably about 7, the pH is substantially below the 9 to 10 pH of the deacidification solution and has virtually no buffering capacity, thus providing two characteristics for distinguishing between the deacidification and cleaning solutions.

DELIVERY SYSTEM

The third component of this spray deacidification system stores and dispenses the deacidification and cleaning solution. It consists of storage containers and an airless spraying system for the nonaqueous deacidification and cleaning solutions. The equipment making up this self-contained, spraying system can be divided into major units including (a) bone-dry, clean, pacified or nonreactive, disposable or reusable, pressurized shipping and storage containers complete withdrawal tubes, valves, and safety devices, to transport and dispense the self-pressurized nonaqueous deacidification solution and the self-pressurized nonaqueous cleaning solution; (b) a dispensing system consisting of a nonreactive 3-way valve to connect the pressure cylinders to a nonreactive plastic hose leading to the spray gun inlet to which the hose is preferably connected with a nonreactive, sealing, stainless steel (or other nonreactive) quick-disconnect apparatus; and (c) a spray gun preferably having stainless steel or other nonreactive wetted parts including stainless steel quick-disconnect connectors and stainless steel interchangeable spray tips to provide different spray patterns for large and small book and document sizes. The shipping storage containers can be supplied without withdrawal tubes if it is desired to use the cylinders with the valves oriented in a downward position.

Special attention is necessary for selection of the various parts of the delivery system, most particularly, those which are continuously wetted. The metal parts must not only be pacified toward or nonreactive with the various deacidification agents, solvents, propellants, and gaseous components, but also must not catalyze other reactions and must prevent atmospheric contamination. Certain common metals like carbon steel (made nonreactive by solution formulation as disclosed above) and stainless steel are satisfactory. Other common metals like brass, copper, zinc, tin and aluminum are not acceptable. However, plated coatings like nickel or chromium; or glass, stainless steel, or inert plastic linings can be used to improve or make common metals acceptable. My preferred metals are stainless steel for continuously used components and pacified carbon steel for disposable components which are continuously wetted.

Most elastomeric and plastic hose materials are affected by the deacidification and cleaning solutions and embrittle or lose strength as well as sometimes cause discoloration of the solutions. Nonreactive hoses, for example, reinforced ethylene vinyl acetate hoses, such as used for dispensing reactive, hazardous catalyst components of industrial coatings and plastics, are normally good choices. Alternately, inert plastics like Teflon and Vitron plastics, e.g., inert polyfluorocarbon plastics, used for lining nonresistant hoses have been found satisfactory.

With reference to shipping and storage containers, I unexpectedly discovered that completely satisfactory pressure vessels did not exist for storage and delivery of the deacidification and cleaning solutions. Stainless steel pressure vessels had to be reused because they are too expensive to discard. Reuseable industrial carbon steel were satisfactory if they were especially pacified by heat treatment and had developed a protective oxide coating from reaction with air. However, such cylinders are, together with their valves and accessories, expensive and must be cleaned before they are useable. In addition to return freight costs, the cylinders must be dismantled, pressure washed with an anhydrous chlorofluorocarbon solvent at pressures up to 1000 psig, dried, valves replaced, evacuated to 2 Torr and tested for leaks, and pressurized to 100 psig, and again tested for leaks and painted before they are suitable for reuse. This preparatory process is not only expensive, but it contributes greatly to reducing the use of my discoveries by archives, libraries, and museums. Most libraries are neither equipped to receive nor have the personnel to handle 200 pound cylinders. Trucking companies generally are not set up for and give poor service both delivering and picking up single cylinder shipments. Thus, it is imperative to find means to use relatively low cost and disposable containers for the cleaning solution.

This discovery leading to the use of disposable cylinders for cleaning solutions was unknown to the industry. Moreover, the major American supplier of chlorofluorocarbon solvents was not only unaware of the problem but was unable to suggest a solution beyond using an anti-oxidant like nitromethane or applying an inert coating, e.g. a baked-on epoxy-phenolic coating.

SPRAY GUN

The spray gun is perhaps the most difficult equipment component because it must dispense the solutions uniformly, in a soft spray, without malfunctioning or clogging. All known commercial spray guns are unsuitable for spraying nonaqueous deacidification solutions because they leak, drip, clog, and/or spray unevenly. Guns having stainless steel wetted components are the best choices when an industrial spray gun is selected. However, ordinary gasket and packing materials wear, dissolve, and produce stains or introduce sufficient moisture to cause clogging or otherwise affect spraying quality. Teflon and Vitron plastics, though expensive, are partially satisfactory, but they tend to flow and tear when connections are tightened. The gasketing material should be white nitrile rubber or equivalent materials.

The spray gun must apply these deacidification solutions in a soft gently spray, very much like a heavy foggy mist, causing no damage or change to fragile papers on which chalky (crumbling) deteriorated inks lie. The spray gun should spray a narrow pattern at a wide angle. The spray angles should be between 65° and 80°.

Compressed air spray guns clog due to the evaporation inside the gun or at orifices when compressed air is introduced to atomize the liquid stream. This evaporation causes the deacidification agent to precipitate and gradually build up producing deposits that clog passageways or deform spray patterns.

The low viscosity or thinness, estimated at one sixth that of water, of the deacidification and cleaning solutions causes an unexpected problem. These liquids leak along the threaded joints and cause dripping which is not only inconvenient but also can drip upon and deface a book undergoing treatment. The white nitrile rubber gaskets are used so finger tight joints seal and thereby avoid the use of tape joints.

SPRAY BOOTH

The fourth component of the system is a spray booth suitable for deacidifying both single sheets of paper and books. Although articles could be sprayed laying flat on a table, a specially designed spray booth is desired to protect workers against solvent vapors, hold and protect the works being treated against damage during treatment, and improve the quality of treatment by providing better uniformly of deacidification. Moreover, the spray booth must serve to prevent abrading defacement or other removal of the printed words as well as prevent migration of soluble inks sideways in the paper substrate.

The spray booth which I have developed for deteriorated fragile books and documents provides (1) a spray booth enclosure with multiple spraying surfaces for deacidifying both (a) single sheet items like maps and documents and (b) bound books, and (2) a variable speed exhaust fan including exhaust ducts and filters. The unique aspects of this booth ar that single sheet objects can be supported on open mesh, such as cheesecloth held in a slanted position. The preferably tautly, held cheesecloth provides a flat, safe, nondamaging support for deacidifying even the most fragile and brittle paper during treatment. The speed of the fan is adjusted so the paper object sprayed can be gently layed into position without stress, securely held during deacidification, and removed without damage after treatment. In addition, the suction produced by the fan causes the deacidification spray solution to flow vertically downwards through the paper and treat all parts of the paper substrate before it evaporates. This flow minimizes, if it does not totally prevent, soluble, which rarely occur, inks from running, smudging and feathering, as a consequence of solvent attack. Because most inks and ink mediums or components are not solubel in nonaqueous deacidification solutions disclosed herein, ordinary collections can be protected without prior testing of unknown inks, thus avoiding a very great testing and sorting expense. Moreover, the slanted surface for flat single sheets is placed at the front surface without projections so that very large sheets of paper, such as maps or engineering drawings, and even scrolls, can be unrolled and spray deacidified as the paper is moved across the slanted surface.

Inside the spray booth, a recessed platform is provided for books to be spray deacidified page by page. For example, students working part-time at the Princeton University Library were able to spray deacidify about three books, measuring 6"×9" with 300 pages, per hour. Records indicate these books are deacidified at $9.00 to $10.00 each, 50 to 100 percent less expensive than methods heretofore available for preserving Special Collections. Even more astonishing, when capital costs are considered, the deacidification costs 30 to 40 percent less than similar books are projected to cost when deacidified in the Library of Congress Mass Deacidification Facility presently being installed at Fort Detrex, MD.

SPECIFIC EXAMPLES

EXAMPLE 1

A steel cylinder measuring approximately 10 inches in diameter by 54 inches high (manufactured from ⅛ inch steel plate) such as used for transport of air conditioning and refrigeration chlorofluorocarbon gases was pressure washed at 1000 psig with trichlorotrifluorocarbon solvent to remove any residual dirt, water, solvent, or scale. A nickel plated brass valve attached to a 5/16 inch i.d. stainless steel dip tube was fitted into the outlet and sealed. The cylinder was pressure tested at 100 psig before vacuum drying to at least 2 Torr. The cylinder was checked during both tests and no leaks were detectable.

The cylinder was first filled with 86.6 percent by weight of trichlorotrifluoroethane and then with 4.0 percent by weight of methoxy magnesium methyl carbonate solution prepared by dissolving 0.7 percent by weight of magnesium ethoxide in 3.3 percent by weight of anhydrous methanol in the presence of carbon dioxide gas. Then 9.5 percent by weight of chlorodifluoromethane was added as propellant. Unless otherwise specified herein, percentages are based on the total composition. The cylinder was at a pressure of 60 psig at ambient temperature and then the cylinder was further pressurized with nitrogen gas to 75 psig. The contents were mixed by shaking the cylinder for 30 minutes on a see-saw shaker.

The cylinder was allowed to come to equilibrium overnight and then brought to a nearby work area where a stainless steel spray gun was attached directly through a reinforced plastic hose with stainless steel connections to the cylinder.

The deacidification solution prepared above was used to spray deacidify a nineteenth century accounting record book with blue and red alcohol-ink ruled lines for the handwritten entries. Each leaf was sprayed on one side and then turned before proceeding to spray the following leaf. This procedure caused the leaves to dry upwards towards the open surface, thus causing the deacidification solution to migrate upward and thoroughly deacidify the entire substrate of each leaf. After treatment, the book was carefully inspected and none of the ruled lines or ink entries were found to have been affected. Careful tests showed that the entire pH of the leaf on both sides had been changed from an acid condition ranging from 3.9 to 4.4 to an alkaline condition ranging from 8.8 to 9.1. Accelerated aging tests conducted according to TAPPI Method T 453 su-70 indicated the potential life of the book had been increased about 200 years.

EXAMPLE 2

A group of books from Special Collections of a University Library were selected for airless spray deacidification using the deacidification solution of Example 1. The books were placed in a spray booth on a spraying platform set at an angle of about 30° to the horizontal for spraying. The spraying system consisted of an airless spray gun and hose connected directly to the valve of the cylinder.

The books were sprayed page-by-page by part time student employees. These student employees were experienced with using the former system of compressed air pressurized tanks. The cost savings of deacidification spray solution ranged from a minimum of 20 percent up to a maximum of approximately 45 percent. The quality of treatment was superior to the "compressed air" deacidified books. Savings in labor costs, exceeding 60 percent, were found because the spray gun did not clog like the compressed air spraying system did, the deacidification solution did not need to be transferred from a shipping container to a spraying container, and only one pass with the spray gun was necessary per page.

The appearance of the airless sprayed books was superior to the appearance of the compressed air sprayed books in that no trace of surface powder deposits was found.

EXAMPLE 3

A large bench-top spray booth with a working face area 4 feet high by 8 feet wide was constructed and installed with an adjustable fan speed control. A recessed, stainless steel mesh support surface for flat sheet artifacts was installed at an angle of 75° to the horizontal and covered with a fine mesh high quality cheesecloth to provide a uniform support surface. The fan was set at low speed and turned on. Four double folio newspaper leaves were placed and held securely by suction on the support surface.

The two cylinders, one of self-pressurized deacidification solution and another of cleaning solution were installed and manifolded together through a 3-way valve connected to a hose which led to an airless spray gun. The deacidification solution was the same as the self-pressurized spray described in Example 1.

The newspaper leaves were sprayed in two passes using a spray head on the gun which produced a spray pattern approximately 2 inches wide by 20 inches long. Each spray pattern was uniform overall and applied overlapping the other pattern by approximately 2 inches to treat the full folio sheet in two passes. The spray was very wet, gentle like a soft, foggy mist, and it completely impregnated and wetted the newspaper leaves.

On comparison with a conventional airless system, this treatment was found to produce a more uniform deacidification treatment, it dried more rapidly than the conventional airless system.

In the conventional airless system, the deacidification solution is either decanted from the shipping cylinder to a spraying container and pressurized for spraying or alternately spraying pressure is produced on top of the liquid in the shipping cylinder after receipt and installation at the treatment location. Extra labor costs are involved in connecting and pressurizing the shipping cylinder with nitrogen gas, and in providing personnel competent to handle high pressure gases.

The spray gun tended to clog to a greater degree and the same degree of protection against contamination of the deacidification solution is not possible. Moreover, if the container were left pressurized for extended periods or overnight, the spraying solution would not function properly as the pressurizing gas would dissolve into the solution. This gas would flash producing bubbles in the dispensing hoses during spraying because a pressure drop occurred in the hose leading to the spray gun. These bubbles interrupted the spray pattern and produced non-protected areas in the treated articles. Thus, the new system provides equivalent quality of spraying, some savings in applicatin costs, a more uniform treatment and a foolproof technique of maintaining the purity of treating chemical solution.

EXAMPLE 4

A table-top dual purpose spray booth was constructed, using a Muffin type exhaust fan, for treating both books and single sheet objects. The booth was taken to a rare book room of a University Library and its electrical power cord plugged into a conventional 110 volt electrical wall outlet. The flexible exhaust duct of the booth was passed through an open window to exhaust the vapors of the airless deacidification solution. Self-pressurized cylinders of the airless spray deacidification solution and cleaning solution (each contained 12½ gallons and weighed 196 pounds and 175 pounds, respectively) were manifolded together through a stainless steel 3-way valve connected to the spray gun.

Twenty medium value books were selected randomly from a Special Collection and the use of the spraying system demonstrated to staff members and their student assistants. One staff member and one student then practiced on some discarded books for fifteen minutes before underaking to spray deacidify books from the University's collection. No difficulty was encountered by either person. A spray tip was used to produce a spraying pattern length of 12 inches to match the 9 to 10 inch high books, thus preventing excessive losses due to overspray.

One of the selected books was tightly bound and would not open flat. It required special handling to insure all parts of the spine were treated. Every six to eight pages, a special vertical spraying pass was made down the gutter margin with the spray gun to quickly and thoroughly treat the spinal components of the book. Paper towels were placed every five to ten pages to protect the fore edges of the books from deposit of too much deacidification agent due to overspray.

The books were inspected immediately after deacidification was completed. No sign of any change in appearance could be found other than a slight wetness because the books were not completely dry. The following day the books were reinspected, and again no sign of change, e.g. ink migration or change of color, was noticeable. Subsequent pH tests using a contact pH apparatus and liquid pH indicators showed that a uniform and complete deacidification treatment had been accomplished. A folding endurance aging following a standard heat aging test showed an increase in life of two to four times and confirmed the shift from an unstable acid condition to a stable alkaline condition.

The front of the spray booth was replaced and the deacidification of prints and other single sheet documents was demonstrated. Again, both staff and student assistant employees practiced spraying for fifteen minutes before undertaking deacidification of items taken from the University's collection. Prints, watercolors, etchings, and manuscripts, as well as colored maps were treated. No change in appearance was noted, but the paper did feel somewhat stronger, as though it had been slightly sized. Again, pH tests and folding endurance tests confirmed each other and increase in life of two to four times, based on accelerated aging tests, was demonstrated.

EXAMPLE 5

A cylinder of airless deacidification spray solution prepared as described in Example 1 and a cylinder of cleaning solution were transported by unheated truck to a seventeenth century home which was being restored as a National Historic Building. Most of the restoration had been completed, but the original wallpaper had deteriorated due to an acidic condition, pH of 3.8, and needed to be protected against further deterioration. The cylinders were placed in a welders' dolly, manifolded together and connected via reinforced plastic hose to a stainless steel spray gun with an especially selected spraying tip that produced a pattern approximately 24 inches long by 3 inches wide. As the cylinders had been cooled during transport since the air temperature was only 45° F., a medical heating blanket was wrapped around the top of the airless spray deacidification solution and turned on. After ten minutes of warming, the temperature of the vapor was approximately 5° greater than the temperature of the deacidification solution. This differential produced a pressure increase of about 8 psig which assured proper spraying and avoided the necessity of waiting for the chilled deacidification solution to return to room temperature.

The cleaning solution was used to flush the spray gun, hose, and accessories free of any contaminants before spraying commenced. The operator opened the windows to provide ventilation and wore an organic vapor removing respirator to insure workroom air quality regulations were met. The walls of the entire room, measuring 15 feet by 20 feet, were sprayed in 35 minutes. In an adjacent room, which had no windows, a portable fan was placed in the doorway to ensure fresh air was provided below and used air exhausted from above while its wallpaper was spray deacidified. Nondestructive tests were made after treatment had occurred. The deacidification of wallpaper would have been impractical, if not impossible, due to the high costs prior to the development of this portable treatment system.

EXAMPLE 6

The spray deacidification solution used in Example 5 was taken to another room of the building wherein clothing and flags of the first residents were being prepared for exhibit. The linen and cotton fabrics which made up into a wedding dress, several blouses, undergarmets, shirts, and flags were hung from suitable supports and hangers and carefully wetted with the deacidification spray. The pH of the artifacts was changed from approximately 4.6 to 8.9, thus indicating a great increase in stability had been achieved. After drying, there was no change in appearance with the single exception that the garmets had a slightly stiffer, but no objectionable drape.

EXAMPLE 7

In another room of the same historic house, the canvas on which portraits of the first residents were painted had become acidic from air pollution over the years, and, though deteriorated, were not yet in a dangerous condition. Each of the canvas backings was deacidified by spraying on site and allowed to dry before being returned to their hanging position. The pH of the canvas was changed from 3.6 to 9.2. No noticeable change of the image was found. The change in pH indicated that the hazardous acidic condition causing instability had been alleviated.

EXAMPLE 8

The cleaning solutions referred to in prior Examples were prepared in a conventional disposable container which was cleaned and tested as set forth in Example 1. The container was first filled with 29.0 percent by weight of anhydrous methanol to which was then added 42 percent by weight of trichlorotrifluoroethane and 29 percent by weight of chlorodifluoromethane. The container was shaken for fifteen minutes to insure thorough mixing while additional pressurization with nitrogen to 70 psig occurred.

EXAMPLE 9

A carbon steel cylinder, meeting U.S. D.O.T. Specification 39, complete withdrawal tube, glass-filled polypropylene valve stem and Vitron O-ring, as used for commercially shipping liquified gas refrigerants 12 and 22, was filled with 4.5 gallons of deacidification solution formulated as follows: 80.5 percent by weight trichlorotrifluoroethane diluent, 5.5 percent by weight methoxy magnesium methyl carbonate methanol solution, and 14.0 percent by weight chlorodifluoromethane. Nitrogen gas was added as an auxiliary propellant to raise the pressure to 70 psig while the contents of the cylinder were mixed on a see-saw shaker for 5 minutes.

An identical cylinder was filled with 4.5 gallons of cleaning solution formulated as follows: 46.80 percent by weight trichlorotrifluoroethane, 11.70 percent by weight methanol, and 0.10 percent by weight methoxy magnesium methyl carbonate methanol solution, and 41.4 percent by weight chlorodifluoromethane. Nitrogen gas was added to give a pressure of 125 psig while the contents of the cylinder were mixed on a see-saw shaker for 5 minutes.

These two cylinders of deacidification and cleaning solution were shipped via a commercial parcel delivery service for test in a regional conservation laboratory. A spray booth and delivery system, as described, were delivered separately. The spray booth was plugged into a 115 volt electrical outlet and the exhaust duct vented through an adjacent exterior wall. The outlets of the valves of the cylinders of deacidification and cleaning solutions were connected through flexible nonreactive plastic tubing to a 3-way stainless steel valve whose outlet was connected through nonreactive tubing to a spray gun whose wetted parts were stainless steel.

The restoration of a group of books that clients had sent was completed and these books only needed deacidification to protect them against acid attack. A low unit cost mass deacidification system was not available, and the books were neither uniquely valuable nor had they been "taken-down" to sheet form during their restoration.

These books were taken one-by-one and spray deacidified by a conservation technician following instruction by a professional conservator. The delivery system: hoses, 3-way valve, connectors, and spray gun, were flushed with cleaning solution to insure no foreign matter was present an all residual materials were removed. Each page of books with thick or dense paper was sprayed. Only one side of the leaves was sprayed on thin, e.g. bible papers.

The pages of books which laid "flat," i.e. open fully, were sprayed directly. The pages of the books which were "tightly bound," i.e. snapped shut when laid flat, were sprayed normally; but the gutter (inner) margin of every 3 to 5 leaves was wetted by spraying it with an aerosol spray can of deacidification solution with an extension nozzle to give a narrow spray. The pages of in between books were held open by the (right-handed) operator's left-hand and sprayed normally. The gutter margin also was sprayed with a quick vertical pass of the spray gun to insure thorough treatment into the binding. Just before completing the last book, the operator closed the valve of the delivery cylinder and used the deacidification solution in the hoses, etc. to treat the last few pages.

The 3-way valve was turned to the Cleaning Solution cylinder which was opened and the hoses, connectors, valves, and spray gun flushed clean of residual deacidification solution. The slight deposit of deacidification agent on the orifice of the spray gun tip was removed with a stiff bristled Nylon brush similar to a toothbrush. The valve to the Cleaning Solution cylinder was closed and part of the Cleaning Solution was sprayed out. A residual quantity was left to insure the hose and its connections and valve were kept wetted. The spray gun was removed from the hose; and its moving parts and the self-sealing, quick disconnector lubricated with a fine machine oil aerosol lubricant. This cleanup/shutdown procedure required just over five minutes.

The deacidified books were inspected by the Conservator and Administrator of the Center for appearance and thoroughness of treatment. One dummy "tightly-bound" book was taken apart to check the inner margin with test solutions. All tests showed the desired pH shift from unstable acid range of 3.6 to 5.4 to a stable alkaline range of 8.5 to 9.5. No changes in appearance were found. The Administrator declared this new system was "light years" ahead of the Regional Center's compressed-air, deacidification spray system. The various features of the invention which are believed to be new are set forth in the following claims:

What is claimed is:

1. A soft spray system for treatment of cellulosic materials having an image thereon, a delivery system in communication with a container and terminating in an airless spray gun, a deacidification solution in the container minimizing acid attack and aging of cellulosic materials, said solution including a deacidification agent comprising carbonated magnesium alkoxides, a lower alcohol for solubilizing said agent, said lower alcohol being present in an amount sufficient to dissolve said agent and less than that which will detrimentally affect the image, a diluent for said alcohol solution, a propellant having a boiling point below 0° F. and an inert gas in such amount as to maintain a substantially uniform pressure in the container, said propellant serving to propel said deacidification solution from said container through said delivery system to said spray gun, and said solution and said propellant being substantially free from carbon dioxide gas.

2. A system in accordance with claim 1 which further includes a second container and a cleaning solution in said second container for cleaning said delivery system, said second container in communication with said delivery system, said cleaning solution including anhydrous methanol and a chlorofluorocarbon or chlorinated carbon.

3. A system in accordance with claim 2 wherein said chlorofluorocarbon is trichlorotrifluoroethane and said cleaning solution further includes a propellant serving to propel said cleaning solution from said second container through said delivery system to said spray gun.

4. A system in accordance with claim 3 wherein said propellant is a chlorofluorocarbon propellant.

5. A system in accordance with claim 2 further including a manifold connecting said container for said deacidification solution and said container for said cleaning solution to said delivery system.

6. A system in accordance with claim 2 wherein said container is additionally stabilized by addition of a small amount of an alkalizing agent to said cleaning solution.

7. A system in accordance with claim 1 wherein said diluent is a chloroflorocarbon compound having a boiling point below that of said lower alcohol.

8. A system in accordance with claim 1 wherein said propellant is a chlorofluorocarbon gas having a boiling point below 0° F.

9. A system in accordance with claim 1 wherein said diluent is trichlorotrifluoroethane and said propellant is chlorodifluoromethane or dichlorodifluoromethane.

10. A system in accordance with claim 1 which further includes apparatus having a suction surface for holding the cellulosic materials and for minimizing damage to fragile materials.

11. A system in accordance with claim 1 wherein the deacidification agent is an alkaline earth alkoxide.

12. A system in accordance with claim 1 wherein the deacidification agent is a magnesium alkoxide.

13. A system in accordance with claim 1 wherein the deacidification agent is a magnesium alkoxide that has been carbonated with carbon dioxide.

* * * * *

UNITED STATES PATENT AND TRADEMARK OFFICE

CERTIFICATE OF CORRECTION

PATENT NO. : 4,860,685

DATED : August 29, 1989

INVENTOR(S) : Richard D. Smith

It is certified that error appears in the above-identified patent and that said Letters Patent is hereby corrected as shown below:

Column 6, line 15, after "trichlorotrifluoroethane" insert a comma (,).

Column 7, line 15, "throughly" should read --thoroughly--.

Column 9, line 59, "gently" should read --gentle--.

Column 10, line 20, "uniformly" should read --uniformity--;

line 26, after "provides" insert a colon (:);

line 31, "ar" should read --are--;

line 47, "solubel" should read --soluble--;

line 68, "applicatin" should read --application--.

Signed and Sealed this

Twenty-eighth Day of August, 1990

*Attest:*

HARRY F. MANBECK, JR.

*Attesting Officer*

*Commissioner of Patents and Trademarks*